US010518535B2

(12) United States Patent
Kobashi et al.

(10) Patent No.: US 10,518,535 B2
(45) Date of Patent: Dec. 31, 2019

(54) LIQUID EJECTING APPARATUS

(71) Applicant: SEIKO EPSON CORPORATION, Tokyo (JP)

(72) Inventors: Masaru Kobashi, Matsumoto (JP); Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/783,938

(22) Filed: Oct. 13, 2017

(65) Prior Publication Data

US 2018/0111376 A1 Apr. 26, 2018

(30) Foreign Application Priority Data

Oct. 20, 2016 (JP) ..... 2016-205740

(51) Int. Cl.
*B41J 2/165* (2006.01)

(52) U.S. Cl.
CPC ..... *B41J 2/16511* (2013.01); *B41J 2/16508* (2013.01); *B41J 2/16523* (2013.01); *B41J 2/16538* (2013.01); *B41J 2/16544* (2013.01); *B41J 2/16585* (2013.01); *B41J 2002/16514* (2013.01); *B41J 2002/16591* (2013.01)

(58) Field of Classification Search
CPC ..... B41J 2/16511
See application file for complete search history.

(56) References Cited

U.S. PATENT DOCUMENTS 5,608,432 A * 3/1997 Yamaguchi ..... B41J 2/16508 347/22
7,533,958 B2 * 5/2009 Park ..... B41J 2/16547 347/29
2002/0060711 A1 * 5/2002 Ito ..... B41J 2/16508 347/28
2004/0104961 A1 * 6/2004 Hashi ..... B41J 2/16544 347/29
2006/0119640 A1 * 6/2006 Berry ..... B41J 2/16505 347/29
2007/0170279 A1 * 7/2007 Yamamoto ..... B41J 2/16547 239/124
2008/0231655 A1 * 9/2008 Yamada ..... B41J 2/16585 347/30

(Continued)

FOREIGN PATENT DOCUMENTS

JP 2010194950 A * 9/2010
JP 2012-153132 A 8/2012
JP 2014-172238 A 9/2014

*Primary Examiner* — Shelby L Fidler
(74) *Attorney, Agent, or Firm* — Workman Nydegger

(57) ABSTRACT

A liquid ejecting apparatus includes a liquid ejecting portion that has a nozzle and an opening surface in which the nozzle opens and that ejects a liquid from the nozzle toward a medium that is transported along a transport path, a wiper member that wipes the liquid ejecting portion while moving, a guide that guides movement of the wiper member, and a cap that has an opening portion and that is movable between a capping position at which the cap contacts the liquid ejecting portion so that the opening portion surrounds the nozzle and an open position at which the cap is apart from the liquid ejecting portion. When the cap is at the open position vertically below the guide, the opening portion is at least partially covered by the guide.

9 Claims, 3 Drawing Sheets

(56) References Cited

U.S. PATENT DOCUMENTS

| | | | | |
|---|---|---|---|---|
| 2009/0015627 | A1* | 1/2009 | Takahashi | B41J 2/16505 347/32 |
| 2009/0152794 | A1* | 6/2009 | Ishida | B41J 25/308 271/8.1 |
| 2013/0335480 | A1 | 12/2013 | Kataniwa | |
| 2014/0253633 | A1 | 9/2014 | Kobayashi et al. | |
| 2016/0067972 | A1* | 3/2016 | Tanjo | B41J 2/16508 347/32 |
| 2016/0263897 | A1* | 9/2016 | Kobashi | B41J 2/16508 |
| 2016/0271955 | A1* | 9/2016 | Ono | B41J 2/16535 |

* cited by examiner

LIQUID EJECTING APPARATUS

BACKGROUND

1. Technical Field

The present invention relates to a liquid ejecting apparatus such as a printer.

2. Related Art

An existing example of the liquid ejecting apparatus is an ink jet type recording apparatus that includes a nozzle cap for keeping an ink jet head moist and a shutter for closing the nozzle cap (e.g., JP-A-2012-153132).

However, in order to cover the nozzle cap with the shutter, it is necessary to provide a mechanism for moving at least one of the shutter and the nozzle cap. However, there is a problem that the provision of such a mechanism complicates the apparatus construction.

SUMMARY

An advantage of some aspects of the invention is that a liquid ejecting apparatus that is able to cover a nozzle cap while requiring only a simple construction is provided.

A liquid ejecting apparatus according to an aspect of the invention includes a liquid ejecting portion that has a nozzle and an opening surface in which the nozzle opens and that ejects a liquid from the nozzle toward a medium that is transported along a transport path, a wiper member that wipes the liquid ejecting portion while moving, a guide plate that guides movement of the wiper member, and a cap that has an opening portion and that is movable between a capping position at which the cap contacts the liquid ejecting portion so that the opening portion surrounds the nozzle and an open position at which the cap is apart from the liquid ejecting portion. When the cap is at the open position vertically below the guide plate, the opening portion is at least partially covered by the guide plate.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the liquid ejecting apparatus of the invention will be described hereinafter with reference to the drawings. The liquid ejecting apparatus of the invention is, for example, an ink jet type printer that performs recording (printing) by ejecting ink, an example of a liquid, to a medium such as a sheet of paper.

Figure 1:
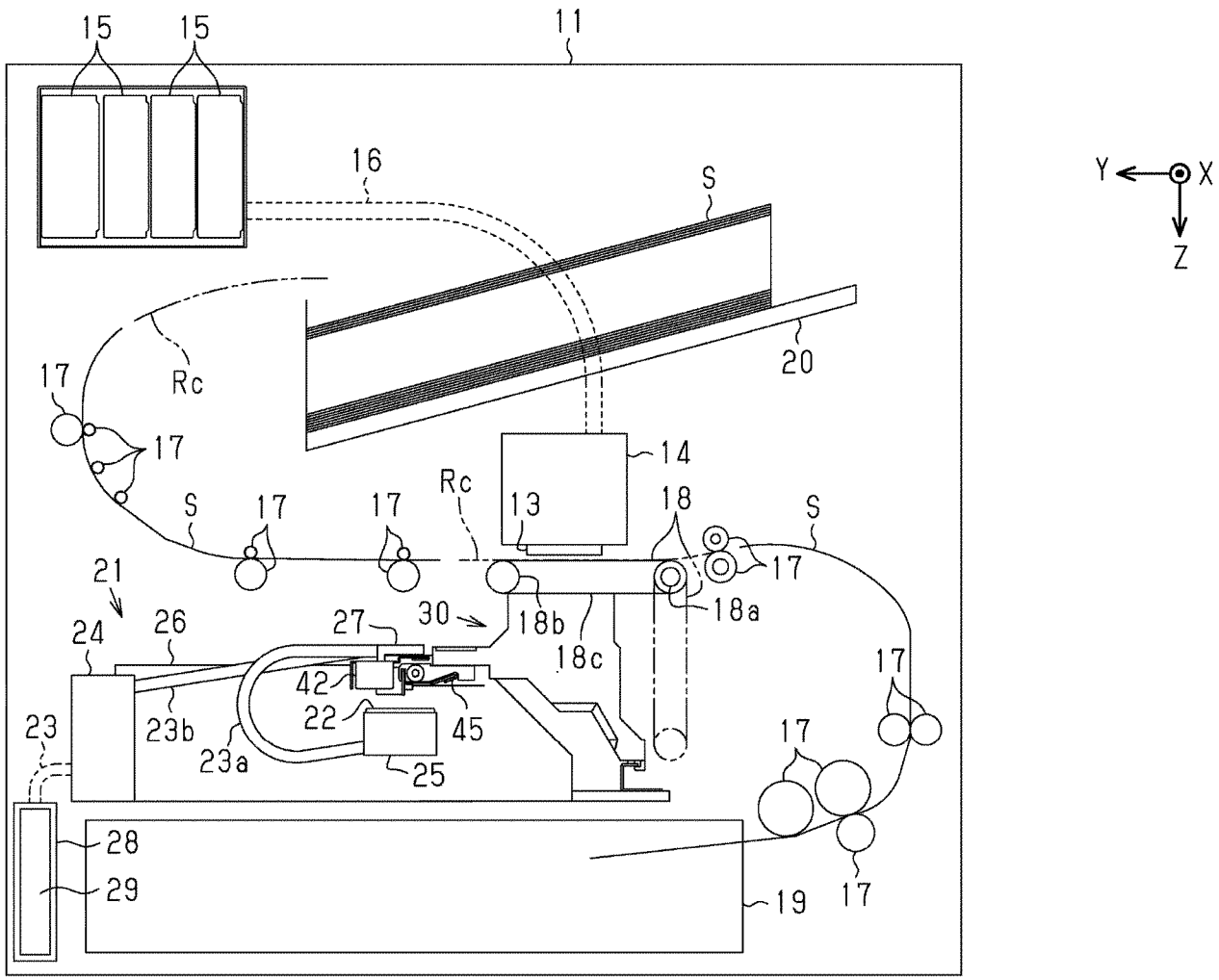
FIG. 1 is an overall construction diagram of an exemplary embodiment of the liquid ejecting apparatus of the invention.

As illustrated in FIG. 1, a liquid ejecting apparatus 11 of an exemplary embodiment includes a liquid ejecting portion 13 that ejects a liquid in an ejection direction Z, a holder portion 14 that holds the liquid ejecting portion 13, a supply flow path 16 that supplies the liquid from a liquid supply source 15 toward the liquid ejecting portion 13, and a plurality of transport rollers 17 that transport a medium S. A position at which the liquid ejecting portion 13 ejects the liquid is termed the recording position. The transport rollers 17 are disposed along a transport path Rc of the medium S which curves and extends from a media housing cassette 19 toward a holding tray 20.

The medium S is transported in a transport direction Y that intersects (orthogonally in this exemplary embodiment) the ejection direction Z of the liquid at the recording position. The liquid ejecting apparatus 11 further includes a medium supporting portion 18 that supports the medium S at the recording position and a maintenance apparatus 21 that performs maintenance of the liquid ejecting portion 13 at the recording position. The medium supporting portion 18 is configured to be movable between a support position (indicated by solid lines in FIG. 1 at which to support the medium S on the transport path Rc of the medium S and a retracted position (indicated by two-dot chain lines in FIG. 1) away from the transport path Rc. The medium supporting portion 18 includes, for example, a transport belt 18*c* wrapped around two rollers 18*a* and 18*b*, and is moved between the support position and the retracted position as the roller 18*b* and the transport belt 18*c* are pivoted approximately 90 degrees about the roller 18*a*.

The liquid supply source 15 is, for example, a cartridge type liquid container that is detachably attached to the liquid ejecting apparatus 11. Alternatively, the liquid supply source 15 may be a liquid tank provided in the liquid ejecting apparatus 11 which is replenished with the liquid by pouring the liquid thereinto.

Figure 2:
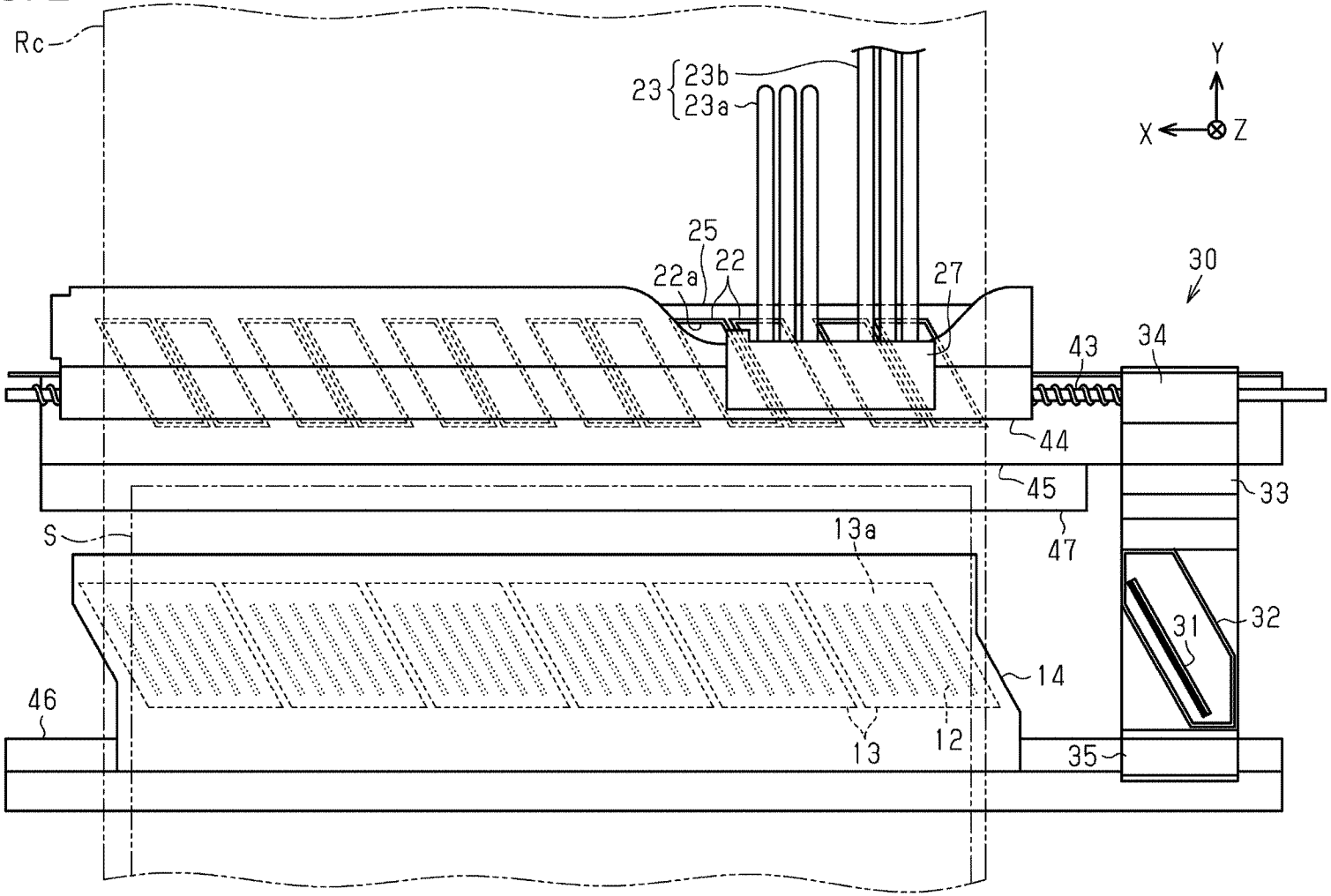
FIG. 2 is a plan view of a maintenance apparatus and a liquid ejecting portion that are provided in the liquid ejecting apparatus illustrated in in FIG. 1.

The liquid ejecting portion 13 in this exemplary embodiment is a line head which extends in a width direction that intersects the transport path Rc of the medium S (see also FIG. 2). The width direction is along a moving direction X that intersects the transport direction Y and the ejection direction Z at the recording position. The liquid ejecting portion 13 performs printing by ejecting the liquid to the medium S as the medium S is transported in the transport direction Y on the medium supporting portion 18 at the support position. The printing range of the liquid ejecting portion 13, which is a line head, spans the entire width of the medium S. In this exemplary embodiment, the ejection direction Z of the liquid is a gravity direction (vertically downward direction); however, the ejection direction Z may instead be a direction that intersects the gravity direction.

The maintenance apparatus 21 includes at least one cap 22 having an mounting portion 28 and an opening portion 22*a* (see FIGS. 2 and 3), a suction tube 23 extending from the cap 22 toward an mounting portion 28, a suction pump 24 provided on an intermediate portion of the suction tubes 23, a cap holder 25 that holds the cap 22, and a moving mechanism 26 that moves the cap 22. A waste liquid container 29 capable of containing a waste liquid is mounted to the mounting portion 28. The maintenance apparatus 21 further includes a wiping apparatus 30 that wipes and cleans the liquid ejecting portion 13.

The maintenance apparatus 21 performs maintenance operations, such as flushing, capping, suction cleaning, and wiping, in order to prevent or eliminate incomplete liquid ejection from the liquid ejecting portion 13. When the maintenance apparatus 21 is to perform the maintenance operation, the medium supporting portion 18 moves from a support portion to a retracted position.

As illustrated in FIG. 2, the liquid ejecting portion 13 includes a plurality of nozzles 12 and an opening surface 13*a* in which the nozzles 12 have openings. The nozzles 12 of the liquid ejecting portion 13 are aligned to form nozzle rows in a direction oblique to both the transport direction Y and the moving direction X. Such nozzle rows of the nozzles 12 of the liquid ejecting portion 13 are spaced from each other by predetermined intervals in the moving direction X. Furthermore, the maintenance apparatus 21 in this exemplary embodiment includes two caps 22 for one liquid ejecting portion 13 which are aligned in the moving direction X. The number of caps 22 provided in the maintenance apparatus 21 is arbitrary.

Figure 3:
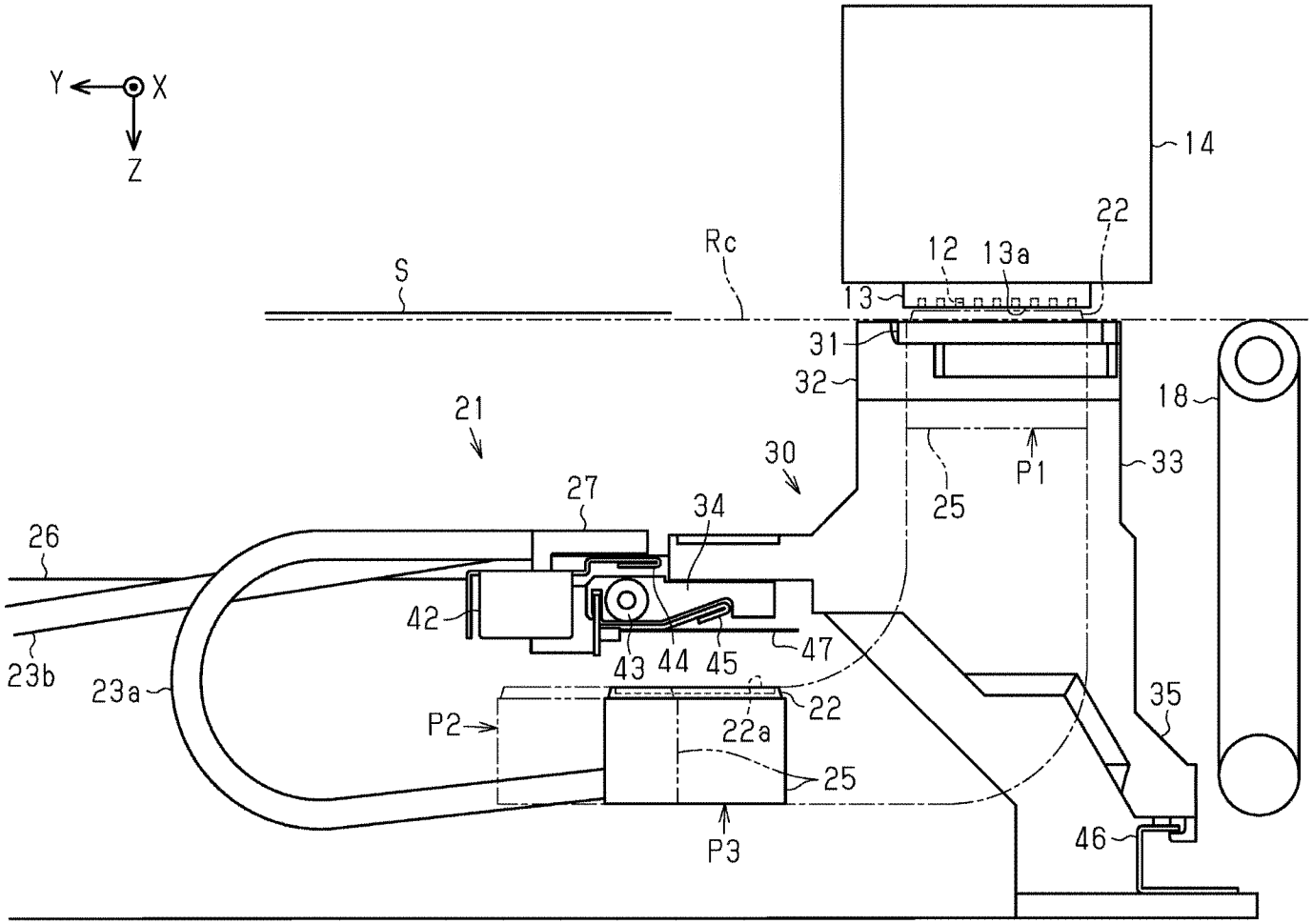
FIG. 3 is a construction diagram of the maintenance apparatus and its adjacent devices and the like provided in the liquid ejecting apparatus illustrated in FIG. 1.

As illustrated in FIG. 3, the moving mechanism 26 moves the caps 22 between a capping position P1 at which the opening portions 22*a* of the caps 22 contact the liquid ejecting portion 13 and surround the nozzles 12 and open positions at which the caps 22 are apart from the liquid ejecting portion 13. Of the open positions, an end position of a movement path of the caps 22 indicated by one-dot chain lines in FIG. 3 is termed a standby position P2 (a position indicated by solid lines in FIGS. 1 and 2).

When the caps 22 are moved, the suction tubes 23 connected to the caps 22 undergo bending displacement and sometimes become folded so that flow of the liquid is impeded. Therefore, intermediate portions of the suction tubes 23 may be fixed to a metal plate 42 or the like by using a fixing member 27 (see also FIG. 2). According to this construction, although upstream portions 23*a* of the suction tubes 23 which extend from the fixing member 27 to the caps 22 undergo bending displacement following the movement of the caps 22, intermediate portions 23*b* of the suction tubes 23 which extend from the fixing member 27 to the suction pump 24 do not undergo a great displacement that leads to the bending of the suction tubes 23.

When the medium S is transported along the transport path Rc, for example, during printing, the medium supporting portion 18 is positioned at the recording position and the caps 22 are positioned at the open position. When the medium supporting portion 18 has moved to the retracted position, for example, after printing ends, the caps 22 move to the capping position P1 and contact the liquid ejecting portion 13, forming a closed space to which the nozzles 12 have openings. Capping is thus carried out. When the liquid ejecting portion 13 does not eject the liquid, capping is carried out to inhibit the drying of the nozzles 12. Although in the exemplary embodiment, the caps 22 contact the opening surface 13*a* of the liquid ejecting portion 13 to carry out capping, the caps 22 may also contact a side surface or the like of the liquid ejecting portion 13 to carry out capping.

Flushing is a maintenance operation of emitting undesirable substances, bubbles, degraded liquid (e.g., an ink whose viscosity has increased due to evaporation of a solvent component), etc. which can be a cause of incomplete ejection, by ejecting the liquid from the nozzles 12 irrespectively of printing. Flushing may be performed before or after printing and may also be performed during printing.

When printing is performed continually on a plurality of media S, flushing may be performed during a time between when a medium S passes a recording position and when the next medium S reaches the recording position (the "time" is referred to as "inter-sheet time"). It is appropriate that the liquid emitted as a waste liquid by flushing be received by the caps 22 When the caps 22 receive the liquid emitted by flushing, the caps 22 are disposed at a receiving position at which the opening portions 22*a* of the caps 22 are positioned on the transport path Rc.

When flushing is to be performed toward the caps 22 during the inter-sheet time, the caps 22 are moved to the receiving position in a replacement manner as the medium supporting portion 18 is moved from the support position to the retracted position. In order to promptly move the caps 22 to the receiving position in such a short time as the inter-sheet time, it is permissible to have the caps 22 ready at a ready position P3 indicated by solid lines in FIG. 3 when the medium S is subjected to printing. The ready position P3 is an open position at which the caps 22 are apart from the liquid ejecting portion 13 and is partway along the movement path of the caps 22 indicated by the one-dot chain lines in FIG. 3.

After the waste liquid emitted by flushing is received by the caps 22, air suction that is caused by driving the suction pump 24 (see FIG. 1) while the caps 22 are apart from the liquid ejecting portion 13 is executed. As air suction is executed, the waste liquid received in the caps 22 is moved to and contained in the waste liquid container 29 (see FIG. 1) via the suction tubes 23.

When the suction pump 24 (see FIG. 1) is driven while the caps 22 cover the liquid ejecting portion 13, that is, during the capping of the liquid ejecting portion 13, the closed spaces formed between the caps 22 and the liquid ejecting portion 13 have negative pressure. Therefore, the negative pressure sucks from the nozzles 12 so that undesirable substances, such as bubbles, together with the liquid are emitted from inside the nozzles 12. This is termed suction cleaning. The liquid emitted from the nozzles 12 by suction cleaning is sent, via the suction tubes 23, to a waste liquid container 29 (see FIG. 1) and contained therein as a waste liquid.

When the liquid ejecting portion 13 ejects the liquid, small mist particles are produced and attach to the liquid ejecting portion 13. Furthermore, when the medium S is transported, paper powder, dust, dirt, etc., fly and attach to the liquid ejecting portion 13. Therefore, at a predetermined timing, for example, after printing is executed, the wiping apparatus 30 performs wiping.

As illustrated in FIG. 2 and FIG. 3, the wiping apparatus 30 includes a wiper member 31 capable of wiping the liquid ejecting portion 13, a liquid receiver 32 that surrounds the wiper member 31, a moving body 33 that holds and supports the wiper member 31 and the liquid receiver 32 and moves, and a guide shaft 43 and guide plates 44, 45 and 46 which guide movements of the wiper member 31 via the moving body 33. The wiper member 31 is, for example, an elastic body made of an elastomer or the like, or a liquid absorber capable of absorbing liquid and made of non-woven fabric or the like. The wiping apparatus 30 may further include an extension portion 47 that extends upstream in the transport direction Y from the guide plate 45. The extension portion 47 is made of, for example, a thin plate or a film.

The guide shaft 43 is, for example, a threaded shaft extending in the moving direction X. The guide plates 44, 45 and 46 are, for example, metal plates extending in the moving direction X. The guide plates 44 and 45 may be portions of a metal plate 42 to which the fixing member 27 is fixed. The guide plates 44 and 46 are not essential components. However, the provision of the guide plates 44 and 46 can stabilize movement of the wiper member 31.

As illustrated in FIG. 3, a lower portion of the moving body 33 has a first engaging protrusion 34 protruding in the transport direction Y and a second engaging protrusion 35 protruding in the ejection direction Z. The first engaging protrusion 34 threadedly engages with the guide shaft 43, which is a threaded shaft. The guide plate 44 restricts vertically upward movement of the first engaging protrusion 34. The guide plate 45 and the guide plate 46 engage with the first engaging protrusion 34 and the second engaging protrusion 35, respectively.

The guide plates 44, 45 and 46 are disposed vertically below the transport path Rc. Furthermore, of the open positions of the caps 22, the standby position P2 and the ready position P3 are set vertically below the guide plates 44 and 45. Then, when the caps 22 are at the standby position P2, the opening portions 22*a* are covered at least partially with the guide plate 45. When the caps 22 are at the ready position P3, the opening portions 22*a* are covered with the guide plate 45 and the extension portion 47.

It is advisable that the standby position P2 and the ready position P3 of the caps 22 be set outside a space located directly under the support position of the medium supporting portion 18 (directly under the recording position) (i.e., be set at a position that does not coincide with either the support position or the recording position in the gravity direction). For example, in the exemplary embodiment, the standby position P2 and the ready position P3 of the caps 22 are set downstream in the transport direction Y from the support position of the medium supporting portion 18 and from the liquid ejecting portion 13.

As the threaded guide shaft 43 rotates in a first rotation direction, the moving body 33 undergoes an outgoing movement in the moving direction X. Conversely, as the guide shaft 43 rotates in a second rotation direction that is the direction opposite to the first rotation direction, the moving body 33 undergoes a returning movement in the direction opposite to the moving direction X. During one of the outgoing movement and the returning movement of the moving body 33, the wiper member 31 comes into sliding contact with the liquid ejecting portion 13 while moving and therefore wipes the liquid and the like off the liquid ejecting portion 13. This is termed wiping.

Next, operation of the liquid ejecting apparatus 11 constructed as described above will be described below.

When the medium S is transported along the transport path Rc, dust or dirt accumulated on the transport path Rc and dust or dirt attached to the medium S flies off and falls. Particularly, when the medium S is paper, paper powder present on end portions or the like of the sheet of paper flies off. Furthermore, when the medium supporting portion 18 pivots from the support position to the retracted position, dust, dirt, or the like accumulated on the transport belt 18*c* falls downward.

If such dust, dirt, or the like attaches to the opening portions 22*a* of the caps 22 or the like, a gap is formed between the opening portions 22*a* and the liquid ejecting portion 13 during capping. In such cases, the suction force during suction cleaning can sometimes be insufficient to eliminate the incomplete ejection of the liquid ejecting portion 13. Furthermore, dust, dirt, or the like attached to the opening portions 22*a* of the caps 22 moves to the liquid ejecting portion 13 and stains the liquid ejecting portion 13 during capping.

According to this exemplary embodiment, however, when the caps 22 are at the standby position P2, an upstream side of the opening portions 22*a* of the caps 22 in the transport direction Y is covered by the guide plate 45, so that dust, dirt, or the like falling from the transport path Rc is less likely to attach to the caps 22. Furthermore, when the caps 22 are at the ready position P3, the opening portions 22*a* of the caps 22 are covered by the guide plate 45 and the extension portion 47, so that dust, dirt, or the like falling from the medium supporting portion 18 is less likely to attach to the caps 22.

The foregoing exemplary embodiment achieve the following advantageous effects.

(1) When the caps 22 are at a waiting position (the standby position P2 or the ready position P3) during printing, the guide plate 45 that guides movement of the wiper member 31 covers the opening portions 22*a* of the caps 22; therefore, there is no need to provide a member for covering the caps 22, such as a dedicated shutter.

(2) Since the guide plate 45 is the metal plate 42, a structural strength of the liquid ejecting apparatus 11 can be secured. Furthermore, since the metal plate 42 for securing a strength and the guide plate 45 for guiding movement of the wiper member 31 are provided as a single member and the guide plate 45 serves also as a cover for the caps 22, the number of component members can be reduced.

(3) The guide plate 45 covers the opening portions 22*a* of the caps 22 without contacting the caps 22. Therefore, the guide plate 45 does not impede the movements of the caps 22.

The foregoing exemplary embodiment may be changed as in modifications illustrated below. Constructions and the like included in the foregoing exemplary embodiment and constructions and the like included in the following modifications may be arbitrarily combined. Furthermore, constructions and the like included in the following modifications may also be arbitrarily combined. Note that, in the following description, components and the like that have substantially the same functions as the components and the like described above will be designated by the same reference characters and redundant descriptions will be avoided.

In a modification in which the caps 22 do not stop at the ready position P3 but wait at the standby position P2 during printing, the extension portion 47 does not need to be provided. Alternatively, the extension portion 47 made of a separate member may be omitted and the guide plate 45 may be extended so as to cover the opening portions 22*a* of the caps 22 when the caps 22 are at the ready position P3.

When the guide plate 45 covers the caps 22 at an open position, the guide plate 45 may contact the opening portions 22*a* of the caps 22. Furthermore, when the extension portion 47 covers the caps 22, the extension portion 47 may contact the opening portions 22*a*. In this case, the opening portions 22*a* of the caps may be sealed by the guide plate 45 or the extension portion 47 to substantially prevent the interior of the caps 22 from drying.

During movement of the caps 22, the opening portions 22*a* may be caused to slide on a member so that dust, dirt, or the like attached to the opening portions 22*a* transfers to that member. That member may be a dedicated cleaning member such as an absorber capable of absorbing the liquid, or may be the same member as the guide plate 45 or the extension portion 47.

The medium supporting portion 18 does not necessarily need to pivot between the two position. For example, the medium supporting portion 18 may be configured to be slidingly movable along the transport direction Y between the support position and the retracted position. In this case, it is advisable that the retracted position be set upstream in the transport direction Y from the support position.

The liquid that the liquid ejecting portion 13 ejects is not limited to ink but may also be, for example, a liquid material formed by dispersing or mixing functional material particles in a liquid. For example, the liquid ejecting apparatus 11 may be configured to perform recording by ejecting a liquid material that contains in the form of a dispersion or solution of a material, such as an electrode material or a color material (pixel material), that is used in manufacturing liquid crystal displays, electroluminescence (EL) displays, surface emitting displays, etc.

The medium S is not limited to a sheet of paper but may also be a plastic film, a thin plate, etc., and may also be a cloth for use in a textile printing apparatus or the like.

Technical ideas advantageous effects thereof that can be understood from the exemplary embodiments and the modifications described above and operations and will be described below.

Technical Idea 1

A liquid ejecting apparatus characterized by including a liquid ejecting portion that has a nozzle and an opening surface in which the nozzle opens and that ejects a liquid from the nozzle toward a medium that is transported along a transport path, a wiper member that wipes the liquid ejecting portion while moving, a guide plate that guides movement of the wiper member, and a cap that has an opening portion and that is movable between a capping position at which the cap contacts the liquid ejecting portion so that the opening portion surrounds the nozzle and an open position at which the cap is apart from the liquid ejecting portion, wherein when the cap is at the open position vertically below the guide plate, the opening portion is at least partially covered by the guide plate.

According to Technical Idea 1, the cap can be covered by a simple construction in which the guide plate for guiding the move of the wiper member is used also to cover the cap.

Technical Idea 2

A liquid ejecting apparatus according to Technical Idea 1, characterized in that the guide plate is disposed vertically below the transport path and that when the medium is transported, the cap is disposed at the open position.

According to Technical Idea 2, since the opening portion of the cap is covered by the guide plate when the cap is at the open position, dust, dirt, or the like that flies from the transport path as the medium is transported is less likely to attach to the cap.

Technical Idea 3

The liquid ejecting apparatus according to Technical Idea 1 or Technical Idea 2, characterized in that the liquid ejecting apparatus further includes an extension portion extending from the guide plate and in that when the cap is at the open position, the opening portion is covered by the guide plate and the extension portion.

According to Technical Idea 3, since the opening portion of the cap is covered by the guide plate and the extension portion when the cap is at the open position, dust, dirt, or the like is inhibited from attaching to the opening portion.

Technical Idea 4

The liquid ejecting apparatus according to any one of Technical Idea 1 to Technical Idea 3, characterized in that the liquid ejecting apparatus further includes a medium supporting portion movable between a support position at which the medium supporting portion supports the medium on the transport path and a retracted position at which the medium supporting portion is apart from the transport path and in that the open position of the cap is set outside a space located directly under the support position.

According to Technical Idea 4, the cap at the open position is less likely to receive dust, dirt, or the like that falls from the transport path.

Technical Idea 5

The liquid ejecting apparatus according to any one of Technical Idea 1 to Technical Idea 4, characterized in that the liquid ejecting portion is a line head which extends in a width direction that intersects the transport path and in that the guide plate is a metal plate extending along the longitudinal direction.

According to Technical Idea 5, the guide plate, which is a metal plate, can be used also as a reinforcement member for the liquid ejecting apparatus. This combined use of the member can simplify the construction of the liquid ejecting apparatus.

Technical Idea 6

The liquid ejecting apparatus according to any one of Technical Idea 1 to Technical Idea 5, characterized in that the open position of the cap is set downstream of the liquid ejecting portion in the transport direction of the medium.

According to Technical Idea 6, when the medium becomes wet by receiving the liquid ejected from the liquid ejecting portion, the flying from dust, dirt, etc. from the medium becomes less likely. Therefore, disposing the cap at the open position downstream of the liquid ejecting portion in the transport direction reduces the amount of dust, dirt, or the like that falls down toward the cap.

The entire disclosure of Japanese Patent Application No. 2016-205740, filed Oct. 20, 2016, is expressly incorporated by reference herein.

What is claimed is:

1. A liquid ejecting apparatus comprising:

a liquid ejecting portion that has a nozzle and an opening surface in which the nozzle opens and that ejects a liquid from the nozzle toward a medium, a wiper member that wipes the liquid ejecting portion while moving, a guide that guides movement of the wiper member, a cap that has an opening portion and that is movable between a capping position at which the cap contacts the liquid ejecting portion so that the opening portion surrounds the nozzle and an open position at which the cap is apart from the liquid ejecting portion, and a cover member that extends from the guide, wherein when the cap is at the open position the cover member covers the opening portion, wherein the liquid ejecting portion ejects the liquid toward the medium transported in a transport direction, and wherein the open position of the cap is set downstream of the liquid ejecting portion in the transport direction of the medium.

2. The liquid ejecting apparatus according to claim 1, wherein the cover member is provided outside a space located directly under a support position where a medium supporting portion supports the medium.

3. The liquid ejecting apparatus according to claim 2, wherein the medium supporting portion supports the medium transported in a transport direction, and wherein the cover member is provided on a downstream side of the space in the transport direction.

4. The liquid ejecting apparatus according to claim 1, wherein the liquid ejecting portion is a line head which extends in a width direction that intersects a transport direction in which the medium is transported, and wherein the guide is a metal plate extending along the width direction.

5. The liquid ejecting apparatus according to claim 1, wherein the cover member is provided vertically below the guide.

6. The liquid ejecting apparatus according to claim 1, wherein the cover member is provided between the open position and the capping position in a vertical direction.

7. A liquid ejecting apparatus comprising:

a liquid ejecting portion that has a nozzle and an opening surface in which the nozzle opens and that ejects a liquid from the nozzle toward a medium, a wiper member that wipes the liquid ejecting portion while moving, a guide that guides movement of the wiper member, a cap that has an opening portion and that is movable between a capping position at which the cap contacts the liquid ejecting portion so that the opening portion surrounds the nozzle and an open position at which the cap is apart from the liquid ejecting portion, and a cover member that extends from the guide, wherein when the cap is at the open position the cover member covers the opening portion, wherein the guide is disposed vertically below a medium transport path, and wherein when the medium is transported, the cap is disposed at the open position.

8. A liquid ejecting apparatus comprising:

a liquid ejecting portion that has a nozzle and an opening surface in which the nozzle opens and that ejects a liquid from the nozzle toward a medium, a wiper member that wipes the liquid ejecting portion while moving, a guide that guides movement of the wiper member, a cap that has an opening portion and that is movable between a capping position at which the cap contacts the liquid ejecting portion so that the opening portion surrounds the nozzle and an open position at which the cap is apart from the liquid ejecting portion, and a cover member that extends from the guide, wherein when the cap is at the open position the cover member covers the opening portion, wherein the guide includes a guide plate made of a metal plate.

9. The liquid ejecting apparatus according to claim 8, wherein when the cap is at the open position, the cover member and the guide plate cover the opening portion.

* * * * *